United States Patent [19]

Shu et al.

[11] Patent Number: 4,698,914

[45] Date of Patent: Oct. 13, 1987

[54] SETTING/DRYING PROCESS FOR FLEXIBLE WEB COATING

[75] Inventors: Ming-tsai Shu, Fletcher; William R. Thomas, Jr., Cedar Mountain, both of N.C.; Ann M. Wehner, Princeton, N.J.

[73] Assignee: E. I. Du Pont de Nemours and Company, Wilmington, Del.

[21] Appl. No.: 868,278

[22] Filed: May 29, 1986

[51] Int. Cl.[4] ..... F26B 3/10; F26B 13/20

[52] U.S. Cl. ..... 34/10; 34/23; 34/160; 226/97

[58] Field of Search ..... 34/155, 156, 160, 10, 34/23; 226/97; 427/378, 398.5

[56] References Cited

U.S. PATENT DOCUMENTS

| | | | |
|---|---|---|---|
| 3,065,098 | 11/1962 | Brooks | 117/34 |
| 3,559,301 | 2/1971 | Fraser | 34/156 |
| 3,979,038 | 9/1976 | Karlsson | 34/156 |
| 4,074,841 | 2/1978 | Kramer et al. | 226/97 |
| 4,414,757 | 11/1983 | Whipple | 34/155 |

FOREIGN PATENT DOCUMENTS 363816 12/1931 United Kingdom .

*Primary Examiner*—Larry I. Schwartz

[57] ABSTRACT

A process for preparing a defect-free dry coated flexible web, e.g., plastic film, paper, comprising transporting a web freshly coated on one side, in floating and substantially flutter-free condition through a setting/drying zone having a series of sections each section having at least one push-type and one draw-type gas discharge device, e.g., air bar and air foil, respectively, impinging the web on the side opposite to the freshly coated side at an angle, respectively, of substantially 90° and 0.5° to 5° relative to the transport direction of the moving web whereby a wave form, e.g., a single wave form such as a sinusoidal wave, having a repeating cycle of about 10 to 60 inches (25.4 to 152.4 cm) is produced in the web. The set web coating can be subsequently dried in a web drying zone, if required. The defect-free film is useful as an x-ray film, industrial testing film, graphic arts film, photosensitive element, plastic coated film or paper.

22 Claims, 5 Drawing Figures

SETTING/DRYING PROCESS FOR FLEXIBLE WEB COATING

DESCRIPTION

TECHNICAL FIELD

This invention relates to an improved process for preparing a defect-free coated flexible web. More particularly this invention relates to a process for setting/drying a moving freshly coated web in floating or contact-free and substantially flutter-free conditions without disturbing the uniformity of the coating.

BACKGROUND ART

Many different processes are known for coating various types of moving flexible webs such as plastic films, paper, etc. Moving webs, freshly coated on one side with one of a variety of coating compositions or dispersions, are extremely sensitive to surface and other defects, particularly defects caused by the flowing of the coating prior to setting by chilling or drying with impinging cool or warm air to harden the coating sufficiently. Any defect present in a coating prior to setting is undesirable because the defect may remain in the final product. Such defects are particularly serious when the coating on the web is one of more gelatino silver halide emulsion layers.

Many modern coaters use air floatation devices to set/dry and transport a web from its dispensing mechanism to its receiving mechanism. One common so-called floatation device is a "Hi-Float" system commercially available from TEC Systems, a division of W. R. Grace & Co. The Hi-Float system use alternating uniformly spaced air bars or push-type gas discharge devices on each side of the web for support. This is illustrated in accompanying FIG. 1. Each such device is used to push the web away by means of impinging gas and the moving web thereby floats through the system in a wave form which is a repeating single wave form. By this described system gas is blown on both sides of the web to balance it between upper and lower nozzles, and although much lower gas velocities can be used to set/dry the web coating than in normal drying zones, some coating defects may be observed. One common defect of this described system is the formation of scratches in the web caused by dragging of either side of the web on the air bars as a result of tension upset and/or unbalanced discharge gas between the air bars on the opposite sides of the web. Close clearance air bars often get a buildup of coating material on them which subsequently causes rubs on the web. Another common defect, particularly when coating photographic silver halide emulsion, is "mottle" which is coating nonuniformity shown as spots or blotches in the web coating. It can be a result of the web coating being disturbed by direct gas impingement before the coating is set. Such defects cannot be tolerated and the defective areas either must be removed or in the event that "perfect" quality film is desired for critical end use markets, such as in industrial x-ray film, the entire film is scrapped.

In an attempt to overcome the disadvantages described above wherein gas is impinging on both sides of the film, it is known to use a series of floatation devices, called air foils or draw-type gas discharge devices, on the side of the web opposite to that bearing a fresh coating. This is illustrated in accompanying FIG. 2. Mottle thereby is effectively eliminated, but it has been observed that with this arrangement of floatation devices, due to the fact that the web is continuously being pulled toward the air foils and/or the fact, that in many coating applications, the web has a tendency to curl towards the side of the web opposite to the side bearing a fresh coating, dragging of the side of the web on the air foils can occur causing scratches and rubs in the web. Dragging is the result of the very close clearance between the air foil and the web. The scratch and rub defect areas of the web must either be removed or the film scrapped depending on the particular use for the coated web.

It is desirable that the above disadvantages be overcome and that a substantially defect-free coated flexible web be prepared by setting/drying under floating or contact-free and substantially flutter-free condition.

DEFINITIONS

The following definitions shall apply throughout the specification and claims:

Defect-free coated flexible web means a flexible web bearing a coating having substantially no nonuniformity of coating thickness caused by movement of the coating after being applied to the moving web but prior to setting. In addition, the absence of marks due to the rubbing of the fresh coating, the rubbing of a previously applied and dried coating, or the rubbing of the bar web on the hard surface of the gas discharge devices.

Setting means an increase in viscosity of an applied coating to the state where the coating is sufficiently solidified so that substantially no movement of the coating occurs. The increase in viscosity can occur as a result of chemical reaction in the coating, temperature changes of the coating, and/or loss of volatiles/solvent from the coating.

Flutter-free means that the web does not flap or vibrate.

Net generated pressure means the integrated average of the pressure distribution over the surface of the gas discharge device. The said pressure is taken relative to the ambient pressure on the freshly coated side of the moving web.

Push-type gas discharge device means a gas discharge device that generates a positive net generated pressure. This type of gas discharge device pushes the web away from it, e.g., as in the case of "Hi-Float" air bar.

Draw-type gas discharge device means a gas discharge device that generates a net generated pressure which is either negative or zero. For example with air foils, the gas discharged flows along the contour surface as a result of the Coanda effect. The fast moving gas then pulls the web towards the air foil surface, due to the Bernoulli effect, until the web reaches an equilibrium position wherein the net generated pressure is zero.

Gas means any suitable gas or mixture of gases, including air, which is emitted by a gas discharge pressure generating device.

Wave form refers to the shape of the path taken by the web as it moves in the transport direction past each section of push-type and draw-type gas discharge devices. The same wave form repeated throughout the process is a single wave form.

Sinusoidal path means the travelling of the web in a wavy or serpentine wave form.

Cycle length means the distance between two consecutive peaks (or valleys) along the web path.

Tension means the stretching force which balances the web weight and the net pressure force on the web as it travels between two physical supports.

BRIEF DESCRIPTION OF THE DRAWINGS

In the accompanying Figures forming a material part of this disclosure wherein.

DISCLOSURE OF THE INVENTION

In accordance with this invention there is provided a process for preparing a dry and defect-free coated flexible web, including the steps of setting/drying a moving freshly coated web, comprising transporting the web freshly coated on one side thereof in floating or contact-free and substantially flutter-free condition through a setting/drying zone having a series of sections, each section having at least one push-type gas discharge device and at least one draw-type gas discharge device, the gas discharge from the push-type device impinging the side of the web opposite to the fresh coating at an angle of substantially 90 degrees relative to the transport direction of the moving web and the gas discharge from the draw-type device impinging the side of the web opposite to the fresh coating at about 0.5 to 5.0 degrees relative to the transport direction of the moving web whereby a wave form having cycle lengths of about 10 to 60 inches is produced in said web.

Figure 1:
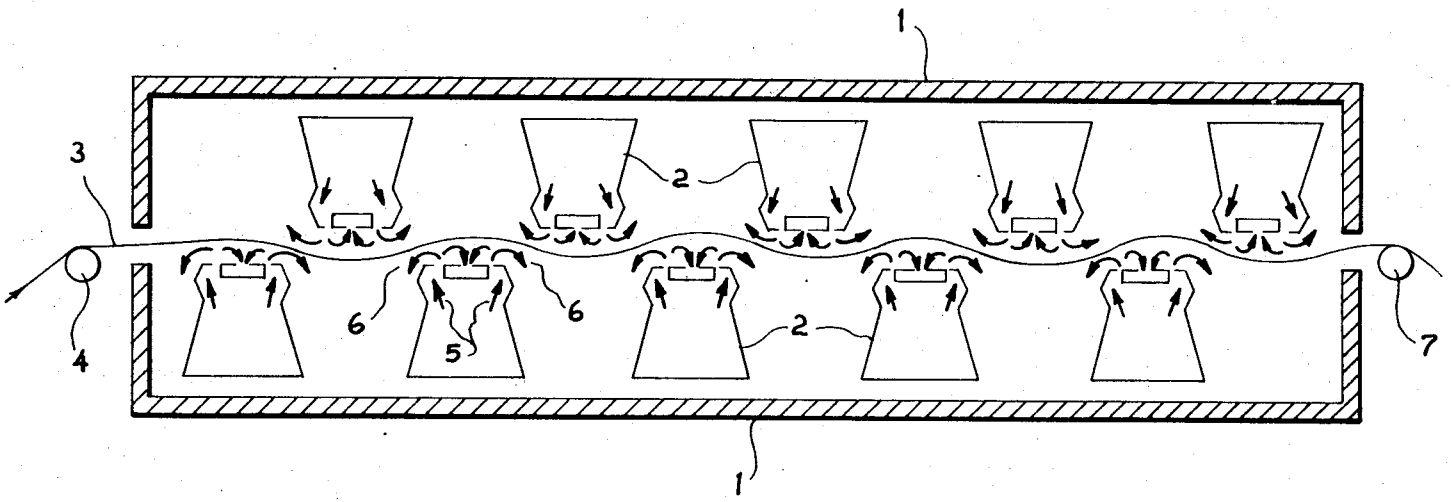
Fig. 1 (Prior Art)
FIG. 1 is a diagrammatic view of a setting/drying zone containing uniformly spaced push-type gas discharge devices alternatingly present on each side of a moving freshly coated web showing gas flow characteristics created thereby. This configuration is known.
Figure 2:
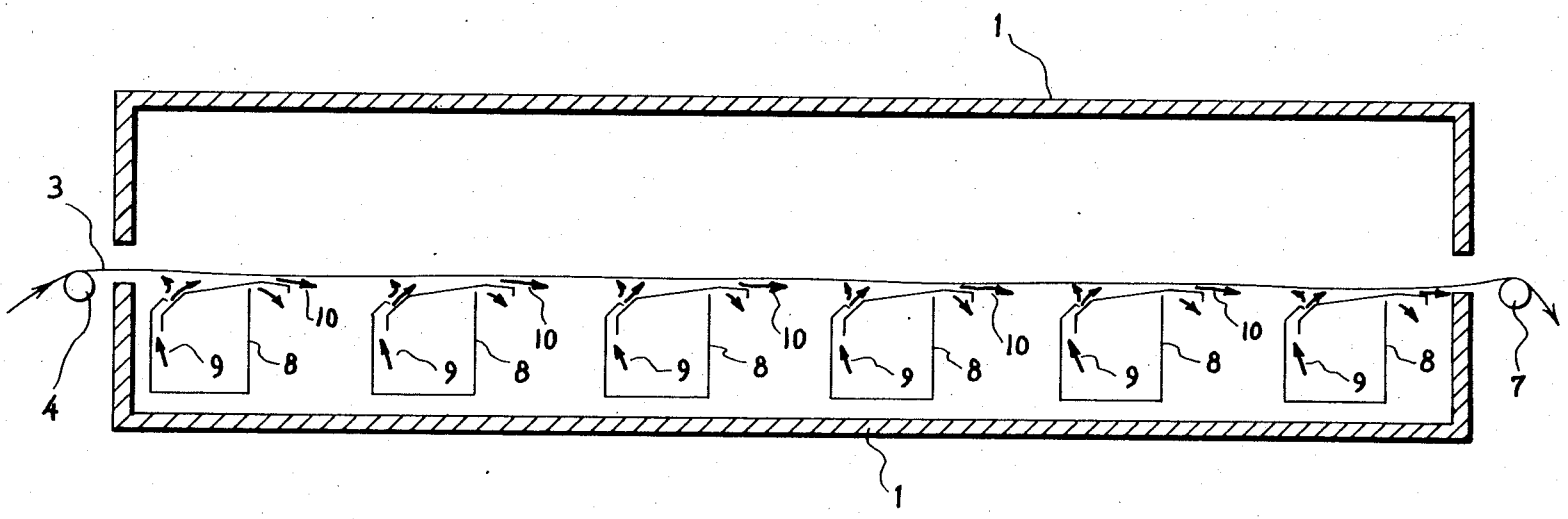
Fig. 2 (Prior Art)
FIG. 2 is a diagrammatic view of a setting/drying zone containing uniformly spaced draw-type gas discharge devices present on the side of a moving freshly coated web opposite to that of the coating showing gas flow characteristics created thereby. This configuration is known.

In the art area of drying and/or moving flexible webs many different variations of push-type and draw-type gas discharge devices have been used. Not only have the devices been modified but their use in the drying process has been varied, e.g., as shown in FIGS. 1 and 2. This invention relates to setting/drying a moving web, freshly coated on one side thereof, to produce a defect-free coated web. Fresh coatings on webs are more subject to defect than webs without coatings, unless strict controls are observed, particularly in the setting/drying operations of such webs. The process of this invention, not having been previously envisioned, enables defect-free coated webs to be obtained under floating or contact free and substantially flutter-free condition without the need for extensively modified devices.

Flexible webs useful in the invention can be any of a multitude of known plastic films, papers, as well as thin metallic foils, etc. While not being limited, the following plastic films are useful: cellulosic supports, e.g., cellulose acetate, cellulose triacetate, cellulose mixed esters; polymerized vinyl compounds, e.g., copolymerized vinyl acetate and vinyl chloride, polystyrene, poly(vinyl acetate), polymerized acrylates, etc.; films formed from the polyesterification product of a dicarboxylic acid and a dihydric alcohol made as described in Alles U.S. Pat. No. 2,779,684 and the patents referred to in the specification of that patent, e.g., polyethylene terephthalate; polyethylene terephthalate/isophthalates of British Pat. No. 766,920 and Canadian Pat. No. 562,272; condensation products of terephthalic acid and dimethyl terephthalate with propylene glycol, diethylene glycol, tetramethylene glycol or cyclohexane 1,4-dimethanol (hexahydro-p-xylene alcohol); polycarbonate, etc. Suitable paper supports, for example, include partially acetylated or coated with baryta and/or an alpha olefin polymer such as a polymer of an alpha-olefin containing 2 to 10 carbon atoms, e.g., polythyelene, polypropylene, ethylenebutene copolymers, etc. The metallic foils which may be used in the process should be of such weight that they float or move in contact-free condition through the setting/drying zone. The width and length of the webs is only limited by the equipment used and available. Web thicknesses can range from a few micrometers to 0.010 inch (0.254 mm) and more.

A variety of different coatings can be coated on the web by various known coating procedures, e.g., dip coating, air knife coating, slide coating, curtain coating, extrusion coating, etc. The coating is initially applied on one side of the web and then after the coating is set or set/dried the other side of the web may be coated, if desired. The coatings on each side of the web can be the same or different. Two or more layers can be coated simultaneously on each side. The thickness of the coating is not critical provided that the web is able to float through the setting/drying zone or zones. It is preferred that the coating be photosensitive, e.g., silver halide emulsions; photopolymer, photocrosslinkable, photodimerizable, phototropic compositions, etc. Examples of silver halide types comprise silver chloride, silver bromide, silver bromoiodide, silver chlorobromide, silver chlorobromideoxide crystals or mixtures thereof. The crystals can be in standard form or in the form of T-grains. The art is replete with examples of useful silver halide type emulsions.

Photopolymer, phototropic, etc. compositions that make useful coatings are disclosed in the following patents, which are incorporated hereby by reference. The invention, however, is not limited to the specific compositions disclosed: U.S. Pat. No. 2,760,863, to Plambeck 3,073,699 to Firestine (addition polymerizable dye-forming compositions), 3,469,982 to Celeste (solvent developable photoresist compositions), 3,854,950 to Held (photohardenable compositions, e.g., disclosed in column 4, line 56 to column 5, line 9), Bratt and Cohen U.S. Pat. Nos. 4,173,673 and 4,229,517 (dot-etchable photopolymerizable compositions), Cohen and Fan U.S. Pat. Nos. 4,247,619; 4,282,308 and 4,304,839 (peel apart photopolymerizable elements for color-proofing and photomasks) Leberzammer and Roos U.S. Pat. Nos. 4,273,857 and 4,353,978 (aqueous developable photoresist compositions), Gervay and Pilette U.S. Pat. No. 4,278,752 (photopolymerizable solder mask) and Du Pont's British Patent No. 1,042,520 (aqueous photopolymer dispersion). Phototropic compounds are disclosed in Cescon U.S. Pat. No. 3,784,557 which is incorporated hereinby reference.

Nonphotosensitive coatings can be present on the web. Examples of these layers are colloids present alone or in combination. The colloid layers are hydrophilic materials including both naturally-occurring substances such as proteins, e.g., gelatin, gelatin derivatives, cellulose derivatives, polysaccharides, e.g., dextran, gum arabic, etc.; and synthetic polymeric substances such as water soluble polyvinyl compounds like poly(vinyl pyrrolidone), acrylamide, etc. Additional nonphotosensitive coatings include thermoplastic polymers or copolymers.

The web, after being coated on one side, is transported into a setting/drying zone. The transporting of the coated web is accomplished by means known to those skilled in the art, e.g., by means of supporting rolls or other devices which maintain adequate tension on the web. The tension applied depends on the type of web being transported, the ratio of the web width to the length between the supporting rolls or other supporting devices, and the floatation mechanism. The transporting mechanism has means to dispense the web and means to collect or wind the defect-free web. In general, the web moves at a rate of 100 to 750 feet/minute (30 to 230 m/minute) and more at a tension of up to 10 pounds/lineal inch (up to ~1.78 kg/lineal cm). Preferably the tension on the moving web is greater than 0.5 pound/lineal inch (0.89 kg/lineal cm). Depending on the type of coating on the web, setting includes either chilling by means of cool gas, heating the coated web, chemical reaction in the coating, or evaporating at least some volatiles/solvent to increase the viscosity of the coating. Gelatin-containing or colloid type coatings, e.g., silver halide emulsion and subbing layers, are chilled to set. Drying of the coated web is also accomplished at least partially in the setting/dry zone. The extent of drying, however, is dependent on several factors such as the coating thickness, the type of web, the length of the setting/drying zone, the speed of the web through the zone, the rate of evaporation of the solvent(s) and/or volatiles from the coating, etc. It is desirable, at times, to provide a separate drying zone containing moving heated gas located subsequent to the setting/drying zone wherein drying of the coated web is completed. After completion of the setting and drying of a coated web, the steps of coating, setting and crying may be repeated with a fresh coating being applied to the opposite side of the web with the gas discharge from the gas discharge devices impinging the previously coated, set and dried web surface. It is also possible to apply coating and drying procedures to the other side of the web immediately after the first coating is set. Coatings on both sides of the web can then be dried simultaneously in a separate drying zone.

FIG. 1 illustrates a known type of setting/drying zone not within the scope of this invention. The setting/drying zone 1 is positioned for passthrough of a moving flexible freshly coated web 3 which enters and exits zone 1 via the idler rolls 4 and 7, respectively. Inside the setting/drying zone 1, the web 3 is floated and transported in a sinusoidal wave pattern by a plurality of uniformly spaced push-type gas discharge devices 2 placed alternately on each side of the web 3. Gas 6 is continuously supplied and distributed to each of the push-type gas discharge devices 2 from suitable source(s), not shown, and continuously impinges the web at an angle of substantially 90 degrees relative to the transport direction of the moving web 3 through the discharging nozzles 5 of each device 2 on both sides of the web 3. Gas 6 ultimately exits the setting/drying zone 1 through passage(s), not shown. The gas velocity through nozzles 5 is in the range of 800 to 14,000 feet/minute, ~244 to 4267 m/minute, preferably 1,000 to 8,000 feet/minute (305 to 2438 m/minute). The configuration of the setting/drying zone of FIG. 1 has a tendency, especially at higher gas discharge velocities, to cause defects in the web coating, such as mottle.

FIG. 2 illustrates a known type of setting/drying zone configuration wherein the defect of mottle is eliminated since no gas impingers directly on the freshly coated side of the web. A problem with the FIG. 2 configuration is that the clearance between the web and the surface of the draw-type gas discharge device may become inadequate due to possible web curl, web vibration (amplitude of the web wave form) and/or tension upset. In FIG. 2 the web setting/drying zone 1 is positioned for passthrough thereof of a moving flexible freshly coated web 3 which enters and exits zone 1 via the idler rolls 4 and 7, respectively. Inside the setting/drying zone 1, the web 3 is positioned and transported almost linearly by a plurality of uniformly spaced draw-type gas discharge devices 8 placed on the side opposite to the freshly coated side of the web 3. Gas 10 is continuously supplied and distributed to each of the draw-type gas discharge devices 8 from suitable source(s), not shown, and is continuously discharged from the devices 8 via the discharging slots 9. The gas discharged from the slots 9 then impinges the web along each contour surface at an angle about 0.5 to 5 degrees relative to the transport direction of the moving web 3. Because of the Bernoulli effect and the Coanda effect, the web 3 is sucked towards the surface of the draw-type gas discharge devices. Gas 10 ultimately exits the setting/drying zone 1 through passage(s), not shown. The gas velocity through discharging slots 9 is in the range of 2000 to 14,000 feet/minute (~610 to 4,267 m/minute), preferably 4,000 to 8,000 feet/minute (1,219 to 2,438 m/minute).

Figure 3:
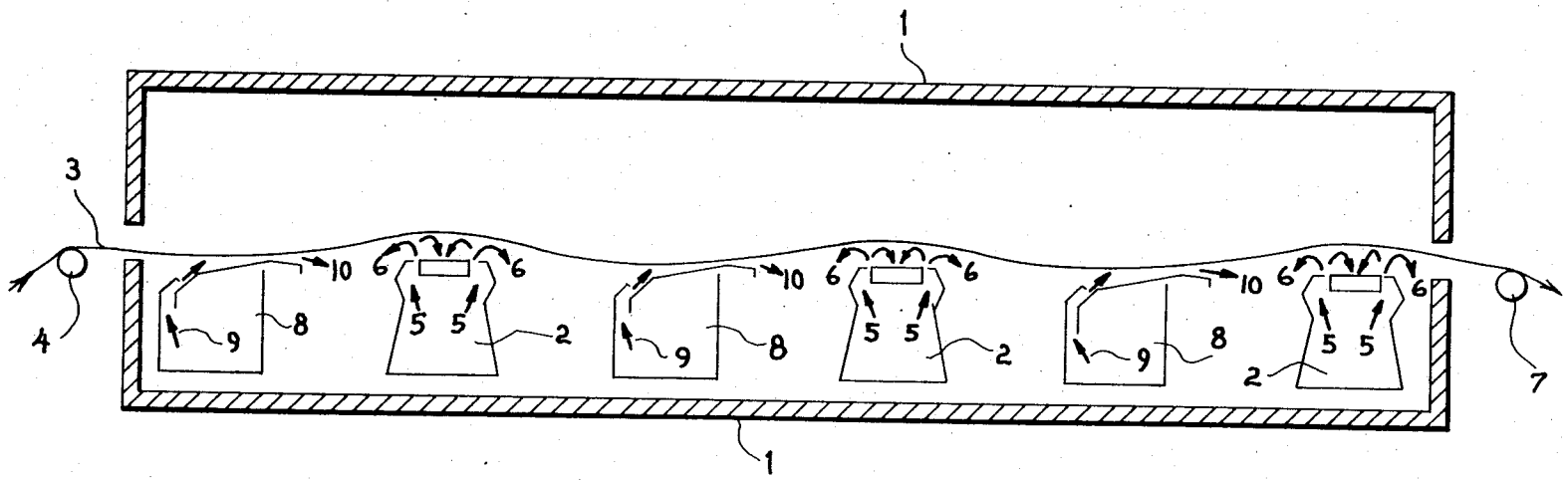
FIG. 3 is a diagrammatic view of a setting/drying zone having three sections each having a push-type gas discharge device and a draw-type gas discharge device present on the side of a moving freshly coated web opposite to that of the coating whereby a wave form is generated in the web according to the invention.

FIG. 3 illustrates the configuration of a setting/dry zone of the invention wherein the web setting/drying zone 1 is positioned for passthrough thereof of a moving flexible freshly coated web 3 which enters and exits zone 1 via the idler rolls 4 and 7, respectively. Inside the setting/drying zone 1, the web 3 is floated and transported by sequentially alternating the push-type gas discharge devices 2 and draw-type gas discharge devices 8 on the side opposite to the freshly coated side of the web 3. Gas is continuously supplied and distributed to each of the push-type gas discharge devices 2 and to each of the draw-type gas discharge devices 8 from suitable source(s), not shown. The gas discharge mechanism from the push-type gas discharge devices 2 is the same as that described in FIG. 1, i.e., discharging nozzles 5. The gas discharge mechanism from the draw-type gas discharge devices 8 is the same as that described in FIG. 2, i.e., discharging slots 9. By balancing the discharge gas velocities between the draw-type gas discharge devices 8 and the push-type gas discharge devices 2, the amplitude of the wave form of web 3 can be regulated and the web transported stably in a wave form with significantly widened minimum clearance between the web 3 and the contour surface of the draw-type gas discharge devices 3 than that of the configuration shown in FIG. 2. A clearance of 0.0625 to 1 inch (0.159 to 2.54 cm) is preferred. The gas 6 and 10 ultimately exits the setting/drying zone 1 through passage(s), not shown.

Figure 4:
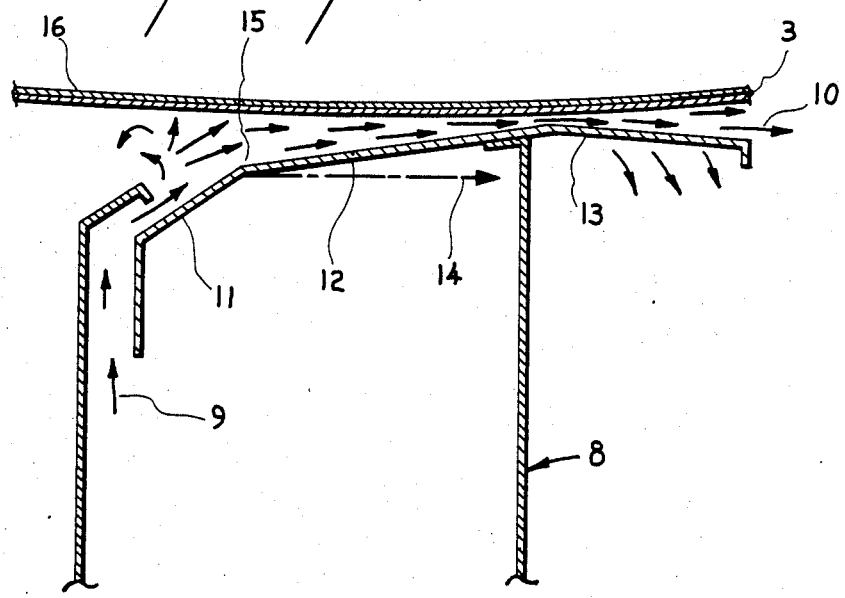
FIG. 4 is an elevational view in section of the upper portion of a draw-type gas discharge device of FIG. 3. The gas impinging on the side of the web opposite to that of the coating is at a small angle relative to the transport direction of the moving web.

FIG. 4 illustrates the specific construction of the draw-type gas discharge device 8 useful in this invention which provides an Coanda effect along the contour surfaces 11, 12, and 13 in the transverse direction 14 of the web 3 utilizing the Bernoulli effect in the region 15 between web 3 and the surfaces 11, 12 and 13.

Due to the Bernoulli effect, the web 3 is pulled towards the gas discharge device to an equilibrium position when the net generated pressure in region 15 is in balance with the ambient pressure on the side of the fresh coating 16. The contour surface 12 is constructed so that it is tilted toward the web 3 at an angle of about 0.5 to 5.0 degrees, preferably 1 to 3 degrees, relative to the web direction 14. This small angle significantly improves the web transport stability.

Figure 5:
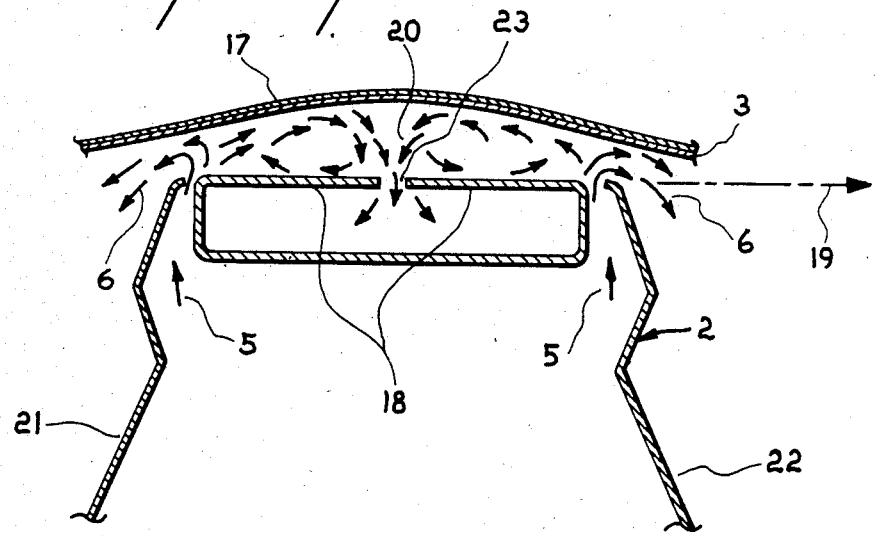
FIG. 5 is an elevational view in section of the upper portion of a push-type gas discharge device of FIG. 3. The gas impinging on the side of the web opposite to that of the coating is at an angle of substantially 90° relative to the transport direction of the moving web.

FIG. 5 illustrates the configuration of the push-type gas discharge device 2 of a type useful in this invention which provides continuous impingement of gas 6 from discharging nozzles 5 on the side of the moving web 3 opposite to that bearing a fresh coating 17 at an angle of substantially 90° relative to the web transport direction 19. Upon impinging the web, some portions of gas 6 flow in a circular like direction in the region of positive discharge pressure 20 between the web and the top surface 18 of device 2 to an exhaust opening 23 present in top surface 18. Most of gas 6 flows into the areas beneath the web and bounded by sides 21 and 22 of device 2. The net positive pressure in region 20 pushes web 3 away from the device 2.

The setting/drying zone is divided into a series of sections, each section having at least one push-type and one draw-type gas discharge device which provide gas impingement on the side of the web opposite to the fresh coating. In its simplest configuration each section has one push-type and one draw-type such device in either order. The setting/drying zone may contain many such sections depending on the length of the zone. In a preferred embodiment each section of the setting/drying zone contains one draw-type device followed by one push-type device (AB). In another embodiment of configuration of the setting/drying zone each section contains a series of draw-type gas discharge devices followed by a single push-type gas discharge device, e.g., AAB-AAB, etc; AAAB-AAAB, etc., or other configuration meeting the requirements of the invention whereby the freshly coated web is transported in a floating or contact-free and substantially flutter-free condition through the setting/dry zone. A stable wave form having cycle or wave lengths of 10 to 60 inches (25.4 to 152.4 cm) is thereby produced in the moving web due to the balancing of the pressure forces on the web as a result of impinging gas velocities from the devices. A preferred cycle or wave length is 24 to 48 inches (~61 to ~122 cm). The wave form, however, can be a single wave form which is repeated in each section of the setting/drying zone. Preferably, when a single wave form is generated it is in the form of a sinusoidal path. The wave form may differ in each section of the setting/drying zone depending on the configuration of the push-type and draw-type gs discharge devices.

A useful push-type gas discharge device is known as a Hi-Float air bar, e.g., type described in Stibbe U.S. Pat. No. 3,873,013 which is incorporated herein by reference. Such a device is commercial available from TEC Systems, Inc., DePere, Wis. The push-type gas discharge device is not limited to the Hi-Float air bar disclosed in the aforementioned patent as other devices of similar configuration can be used for impinging gas discharge on a web at about 90° relative to the transport direction of the moving web. A preferred configuration is illustrated in FIG. 5 of this invention.

A useful draw-type gas discharge device is known as an air foil, e.g., type disclosed in Fraser U.S. Pat. No. 3,559,301 which is incorporated herein by reference. According to this invention the gas discharge from the air foil type device impinges the side of the web opposite to the fresh coating at about 0.5 to 5.0 degrees, preferably 1 to 3 degrees relative to the transport direction of the moving web. This can be accomplished by operating the air foil device at a small angle between the horizontal and the vertical or the air foil can be modified as illustrated in FIG. 4 of this invention.

In a further modification of the setting/drying zone, in the space above the freshly coated side of the web gas is discharged substantially parallel relative to the transport direction of the moving web. Such gas, normally air, can be discharged heated or at ambient temperature or less and effects removal of solvent and/or volatiles by evaporation from the coating. The coating on the web remains defect-free, particularly, since no gas impinges directly on the fresh coating. A preferred mode of the invention is illustrated in Example 3.

INDUSTRIAL APPLICABILITY

The process of this invention results in defect-free coated webs which have been set and dried under floating or contact-free and substantially flutter-free conditions. The process is useful for preparing x-ray, graphic arts and industrial printing products. The process is particularly useful for preparing industrial x-ray film which must be defect-free due to the exacting quality requirements of this type of film, e.g., determining defects in pipes, rockets, etc. In addition, other photosensitive products such as photopolymerizable, photocrosslinkable and dimerizable elements can be prepared, as well as excellent quality colloid and plastic coated films and paper products.

EXAMPLES

The following examples wherein the parts and percentages are by weight illustrate but do not limit the invention.

EXAMPLE 1

Two 0.007 inch (0.178 mm) thick polyethylene terephthalate sub-coated moving supports were freshly coated on one side with gelatino silver halide emulsion and antiabrasion layers and were set and dried using the configuration of push-type and draw-type gas discharge devices as illustrated in FIGS. 2 (Control) and 3, respectively. The draw-type gas discharge devices purchased from TEC Systems, Depere, Wis., a division of W. R. Grace & Co., were situated on the support side of the film and were all tilted so that air impinged the web at an angle of approximately 2° relative to the transport direction of the web. In the configuration shown in FIG. 3 according to this invention, the push-type gas discharge devices also purchased from TEC Systems and the draw-type gas discharge devices were arranged in an alternating sequence with the latter devices tilted at an angle to the web of approximately 2° of the relative to the transport direction of the web as described above.

For example configuration, the web stability was tested over air velocities of 2,000 to 6,500 fpm (1016 to 3302 cm/sec.), line speeds of 150 to 400 fpm (76.2 to 203.2 cm/sec.) and film tensions of zero to 2 pounds/-lineal inch (0 to ~0.36 kg/lineal meter). The center to center distance between the same devices as illustrated in FIG. 2 or the two different devices as illustrated in FIG. 3 was 12 inches (30.48 cm).

With the configuration shown in FIG. 2, some flutter was noticeable especially when tension is lower than 1. With tensions of 1 to 2 pounds/lineal inch (~0.18 to ~0.36 kg/lineal meter) the web could be well positioned at air velocities up to 6500 feet/minute (3302 cm/second). The minimum film clearance was found to be approximately 0.125 inch (~0.32 cm).

The configuration shown in FIG. 3 showed very good film transport stability. The film was transported in a sinusoidal path. The minimum clearance was approximately 0.375 inch (0.95 cm) at the air foil surface when the air velocity was at 3000 feet/minute (1524 cm/sec.). The maximum clearance was 0.5 to 0.75 inch (1.27 to 1.9 cm) at the center of the push-type gas discharge device. The web movement was excellently stable and flutter-free over the tension of 0 to 2 pounds/lineal inch (0 to ~0.36 kg/lineal meter) and no rubbing was observed over a coating period of 0.5 hour. The air temperature used to set the emsulion was between 2° C. to 15° C.

EXAMPLE 2

A polyethylene terephthalate sub-coated moving support 0.007 inch (0.178 mm) thick was freshly coated on one side with gelatino silver halide emulsion and antiabrasion layers and was set and dried using the configuration of repeating sections of 3 consecutive draw-type gas discharge devices followed by 1 push-type gas discharge device. Both types of gas discharge device were as described in Example 1. The draw-type gas discharge devices were tilted so that air impinged the web at an angle of approximately 2° relative to the transport direction of the web.

The web stability was tested over air velocities, line speeds, and film tensions as described in Example 1. The air velocity from the push-type devices was set to be approximately the same as that from the draw-type devices throughout. The center to center distance between the devices was 12 inches (30.48 cm). With this configuration, the web was transported in a sinusoidal path with a repeating cycle length of approximately 48 inches (~122 cm). The web movement was excellently stable and flutter-free over the entire tension range and over the entire air velocity range. At the maximum air velocity of 6500 fpm (3302 cm/sec), the minimum clearance was approximately 0.375 inch (0.95 cm) on the surface of each draw-type gas discharge device and the maximum clearance was approximately 0.5 to 0.75 inch (1.27 to 1.9 cm) at the center of each push-type gas discharge device. No rubbing was observed over a coating period of 0.5 hour. The air temperature used to set the emulsion was between 2° C. to 15° C.

EXAMPLE 3

A polyethylene terephthalate sub-coated support 0.007 inch (0.178 mm) thick was freshly coated on one side with a gelatino silver halide emulsion layer and an antiabrasion layer and was set and dried using the configuration of repeating sections of 3 consecutive draw-type gas discharge devices as described in Example 2 followed by 1 push-type gas discharge device as described below. The dried, coated web was then freshly coated on the other side with the same emulsion and antiabrasion layers and was set and dried using the same configuration of gas discharge devices. The push-type gas discharge devices were as described in Example 2 except that the gas supply to these devices was equipped with dampers to adjust the volumetric gas flow and, accordingly the gas velocity, to the push-type devices. The center to center distance between the devices was 12 inches (30.48 cm). Above the moving web, a third type of gas discharge device was uniformly installed over the entire setting/drying zone. These latter devices discharged circulating gas substantially parallel relative to the transport direction of the moving web, and effected removal of solvent and/or volatiles evaporated from the coatings. The devices were located at a distance of approximately 2.5 inches (6.4 cm) from the moving web, spaced approximately 60 inches (1.52 m) from each other, and discharged circulating gas at significantly lower gas velocities that caused no direct impingement on the web coating.

The gas discharge velocity from the draw-type devices was 5500 fpm (2795 cm/sec) and the gas discharge velocity from the push-type devices was adjusted to 2700 fpm (1370 cm/sec). The web tension used was 1.2 pounds/lineal inch (0.22 kg/lineal meter). With this configuration, the web transported in a sinusoidal path with a repeating cycle length of approximately 48 inches (~122 cm). The web movement was excellently stable and flutter-free from the entrance to the exit of the setting/drying zone. The minimum clearance was approximately 0.375 inch (0.95 cm) at the trailing edge of the 2nd draw-type device in each repeating section and the maximum clearance was approximately 0.6 inch (1.52 cm) at the center of each push-type device. No rubbing was observed over a coating period of 4 hours and the web remained stable when gas pressure nonuniformities were induced by disturbing the gas-supply and gas-return balance above the web coating.

What is claimed:

1. A process for preparing a dry and defect-free coated flexible web, including the steps of setting/drying a moving freshly coated web comprising transporting the web freshly coated on one side thereof in floating or contact-free and substantially flutter-free condition through a setting/drying zone having a series of sections, each section having at least one push-type gas discharge device and at least one draw-type gas discharge device, the gas discharge from the push-type device impinging the side of the web opposite to the fresh coating at an angle of substantially 90 degrees relative to the transport direction of the moving web and the gas discharge from the draw-type device impinging the side of the web opposite to the fresh coating at about 0.5 to 5.0 degrees substantially exclusively relative to the transport direction of the moving web whereby a stable wave form having cycle lengths of about 10 to 60 inches is produced in said web.

2. A process according to claim 1 wherein the set web is transported and dried completely in a web drying zone.

3. A process according to claim 2 wherein the steps of coating and setting/drying are repeated with a fresh coating being applied to the opposite side of the web and the gas discharge from the push-type and draw-type devices impinging the previously coated/set or coated/set/dried surface of the web.

4. A process according to claim 1 wherein the coating is at least one silver halide emulsion.

5. A process according to claim 1 wherein the coating is at least one colloid coating.

6. A process according to claim 1 wherein the coating is at least one polymer coating.

7. A process according to claim 1 wherein the web is a plastic film.

8. A process according to claim 8 wherein the web is paper.

9. A process according to claim 1 wherein the tension on the moving web is up to 10 pounds/lineal inch.

10. A process according to claim 1 wherein the tension on the moving web is greater than 0.5 pound/lineal inch.

11. A process according to claim 4 wherein the setting is accomplished with impinging cool gas.

12. A process according to claim 5 wherein the setting is accomplished with impinging cool gas.

13. A process according to claim 6 wherein the setting is accomplished with impinging cool or warm gas.

14. A process according to claim 1 wherein each section of the setting zone contains one push-type and one draw-type gas discharge device, in either order.

15. A process according to claim 13 wherein the push-type gas discharge device is followed by the draw-type gas discharge device.

16. A process according to claim 1 wherein each section of the setting zone contains a series of draw-type gas discharge devices followed by a single push-type gas discharge device.

17. A process according to claim 1 wherein the gas discharge from the draw-type device impinges the side of the web opposite to the fresh coating at an angle of 1 to 3 degrees relative to the transport direction of the moving web.

18. A process according to claim 1 wherein the gas velocity in the draw-type gas discharge device ranges from 2,000–14,000 feet/minute and the gas velocity in the push-type gas discharge device ranges from 1,800 to 14,000 feet/minute, the air velocities being balanced to yield a stable wave form.

19. A process according to claim 1 wherein the minimum distance of the bottom of the web to the top of a gas discharge device is 0.0625 inch.

20. A process according to claim 1 wherein the wave form is a single wave form which is repeated in each section of the setting/drying zone.

21. A process according to claim 19 wherein the single wave form is a sinusoidal path generated by the gas discharge pressure of the draw-type and push-type gas discharge devices.

22. A process according to claim 1 wherein the setting/drying zone above the freshly coated side of the web air is discharged substantially parallel relative to the transport direction of the moving web to remove solvent and/or volatiles evaporated from the coating.

* * * * *

UNITED STATES PATENT AND TRADEMARK OFFICE

CERTIFICATE OF CORRECTION

PATENT NO. : 4,698,914

DATED : October 13, 1987

INVENTOR(S) : Shu, et al.

It is certified that error appears in the above-identified patent and that said Letters Patent is hereby corrected as shown below:

Column 11, line 18, after "claim", "8" should be --1--.

Signed and Sealed this

Fifteenth Day of March, 1988

*Attest:*

DONALD J. QUIGG

*Attesting Officer*

*Commissioner of Patents and Trademarks*